United States Patent [19]

Salkinoja-Salonen

[11] Patent Number: 4,980,023

[45] Date of Patent: Dec. 25, 1990

[54] METHOD FOR MANUFACTURING PAPER OR CARDBOARD AND PRODUCT CONTAINING CELLULASE

[75] Inventor: Mirja Salkinoja-Salonen, Helsinki, Finland

[73] Assignee: Enso-Gutzeit Oy, Helsinki, Finland

[21] Appl. No.: 280,130

[22] Filed: Dec. 5, 1988

[30] Foreign Application Priority Data

Dec. 7, 1987 [FI] Finland ..... 875386

[51] Int. Cl.[5] ..... D21H 17/22

[52] U.S. Cl. ..... 162/135; 162/158; 162/174; 435/179; 435/277

[58] Field of Search ..... 162/158, 100, 135, 174; 435/179, 277; 106/124, 287, 35; 427/395

[56] References Cited

U.S. PATENT DOCUMENTS 3,966,543 6/1976 Cayle et al. ..... 162/158

*Primary Examiner*—Peter Chin

*Attorney, Agent, or Firm*—Toren, McGeady & Associates

[57] ABSTRACT

The invention relates to a method for manufacturing a paper or cardboard product and to a product manufactured by the method. According to the invention, a cellulase enzyme is added to the product during manufacturing, said enzyme causing the product to decompose when exposed to moisture. The enzyme can be introduced into the product in connection with surface sizing, pigment coating or calendering, or it can be added in the form of a solution which is separately applied to the product in the dry end region of the paper or cardboard machine. Experiments have shown that a product manufactured as taught by the invention can be provided with a plastic coating without risk of destroying the enzyme. Cardboard produced by the method of the invention can be used in the manufacture of packages for liquids, of packing boxes or disposable containers, the cellulase enzyme serving to promote decomposition of the products after they have been brought as waste to dumping areas.

11 Claims, 1 Drawing Sheet

METHOD FOR MANUFACTURING PAPER OR CARDBOARD AND PRODUCT CONTAINING CELLULASE

Figure 1:
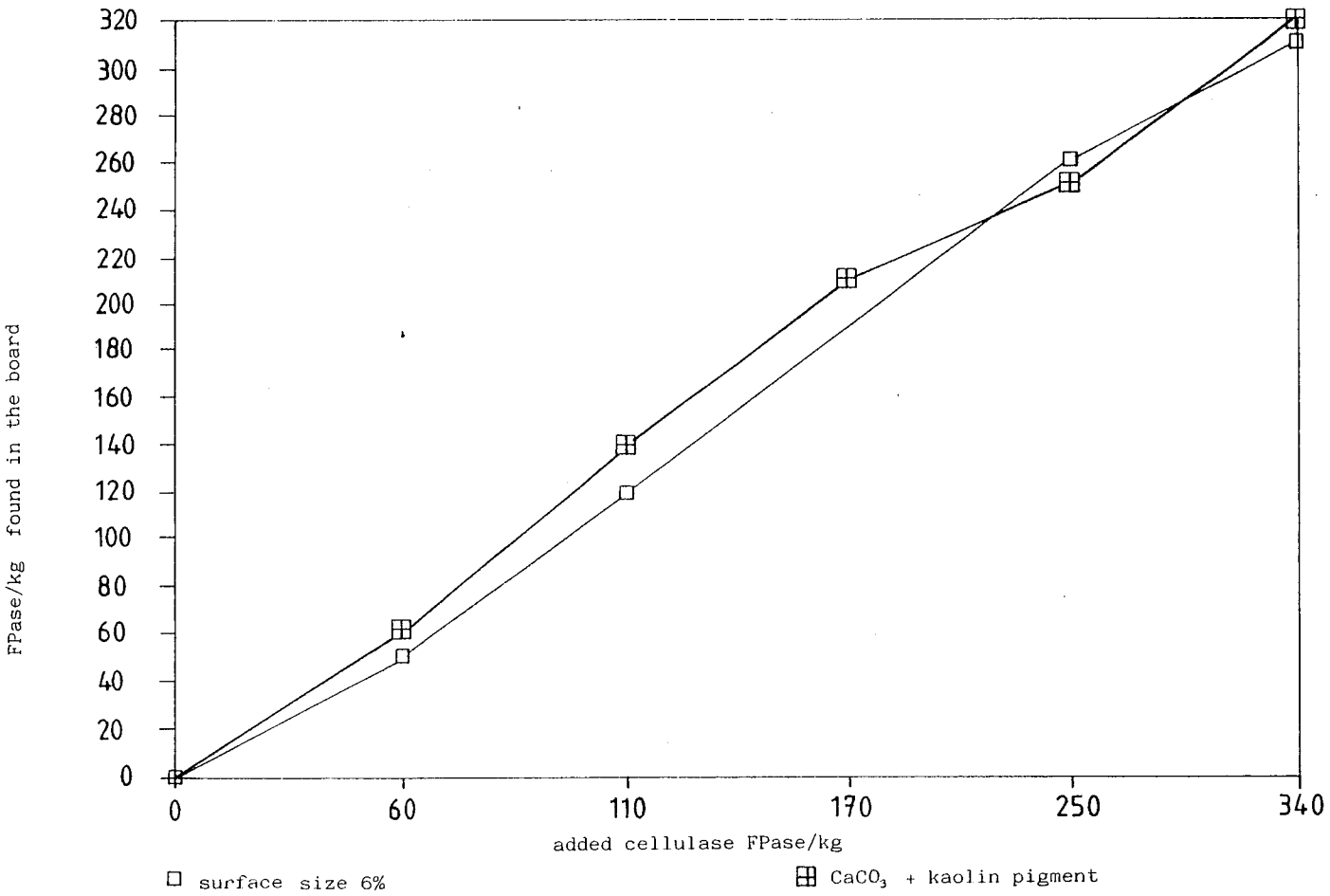

The present invention relates to a method for manufacturing a paper or cardboard product, by which method the product is manufactured with a paper or cardboard machine from a mass containing cellulose.

The principal component in paper and cardboard is cellulose. The cellulose gives the material the required coherence and strength.

Especially cardboard is commonly used in products which, after use, accumulate as waste in dumping areas. Typical examples of such products are the packages used as retail containers for various liquids, e.g. milk, cream, juice etc., and various packing boxes and disposable containers. The problem is the overloading of dumping areas resulting from the abundance of such waste.

Cellulose is a substance that undergoes complete biological decomposition in natural circumstances. The decomposition is mainly effected by enzymes produced by microscopic filamentary fungi living in the soil. These enzymes, called cellulases, decompose cellulose into sugar (glucose), which is further decomposed by bacteria present in the soil.

In natural circumstances, the rate of decomposition of cellulose is determined by the fungi, which are much slower in their growth than bacteria. A further difference between fungi and bacteria is that fungi need plenty of oxygen for their vital processes, whereas bacteria remain fully active even in complete absence of oxygen. In today's large dumping areas where the waste is compacted mechanically, oxygen is only present in the surface layer of the waste mass, which is why biological decomposition of paper and cardboard waste occurs in this layer only. Thus, one of the reasons why dumping areas get so quickly filled up is the fact that sufficient decomposition of the waste is not possible.

On the other hand, it is generally known that if waste containing cellulose, e.g. waste paper, is treated with a cellulase enzyme, decomposition will occur as a result of the activity of bacteria alone, without the contribution of fungi. In this waY, effective decomposition of the waste can be achieved even in circumstances where no oxygen is present.

The object of the present invention is to provide a solution that is conducive to decomposition of dumped paper and cardboard. The invention is characterized in that the paper or cardboard product is provided in the manufacturing process with a cellulase enzyme which causes the product to decompose when exposed to moisture.

The addition of a cellulase enzyme to a paper or cardboard product in the manufacturing process as taught by the invention ensures that decomposition will begin as soon as the product is exposed to moisture in the dumping area independently of the presence of oxygen and filamentary fungi producing enzymes. The result is a decisive improvement in the efficiency of decomposition of paper and cardboard waste and a reduced loading of the dumping areas.

Preliminary tests have shown that it is possible to add a cellulase enzyme to cardboard in the manufacturing process in such a way that the enzyme is preserved in the finished cardboard product. The enzyme can be introduced into the paper or cardboard by mixing it with the surface sizing solution (generally starch), with the primary or secondary coating pigment or with the calender water. It is also possible to add the enzyme separately in the form of a solution, which is applied to the material e.g. by means of a coating knife or similar device or by spraying it directly onto the paper or cardboard web in the dry end region of the machine.

There are several reasons why the addition of the enzyme should be arranged at the dry end of the machine. First, the enzyme will have a better ability to withstand the heat of the drying cylinders if the moisture content of the paper or cardboard web is not too high (preferably 50%). Second, if the enzyme is added at a late stage in the manufacturing process, the enzyme losses will be reduced. Third, such an arrangement prevents the enzyme from getting into the water circulation systems of the machine and further e.g. into the head box, where it might cause deterioration of the pulp fibres. Since cellulase enzymes need water in order to be activated, arranging the enzyme addition at as late a stage as possible in the dry region of the process eliminates the risk of decomposition of the cellulose during manufacturing of the product.

The cellulase enzyme can be added as a thick, stabilized solution or suspension with a dry matter content of e.g. 50%. The enzyme dosage per ton of paper or cardboard produced is at least 5000 FPase units, the advantageous dosage being within 10000–400000 units and the preferable dosage within 50000–100000 units. In packages or disposable containers for foodstuffs, the enzyme employed must of course be of a kind accepted for use with foodstuffs. Examples of suitable cellulase enzymes are Multifect L 250 and Multifect K.

The addition of a cellulase enzyme into cardboard involves no impediment whatsoever to its use as package material. Experimental results so far obtained indicate that the enzyme is preserved in the product at least 5 months without substantial loss in potential activity. It has also been found that a product manufactured as provided by the invention withstands heating in a microwave oven with no substantial risk to enzyme activity. Further, it has been established that a product containing a cellulase enzyme really decomposes faster when exposed to moisture than a similar product containing no enzyme. Still, the decomposition process is not initiated too soon to cause any difficulties regarding normal use of the product.

The paper or cardboard used in packages for liquids and processed food, in disposable cups and plates and in wrappings for meat, cheese and other foodstuffs and in other products of this category is generallY provided with a plastic coating at least on one side. A commonly used coating material is polYethYlene, the amount of which is 8–25 g/m$^2$, but other kinds of plastic may also be used. A plastic coating like this can also be added to paper or cardboard manufactured by the method of the invention Experiments have shown that applying a melted plastic at a temperature of 322° C. to the paper or cardboard involves no appreciable deterioration in the activity of the previously added enzyme.

According to present knowledge, the plastic used as coating on paper or cardboard does not decompose biologically but only under the influence of light or by combustion. Still, even if the paper or cardboard product has a plastic coating on both sides, this is no obstacle to biological decomposition of the material because the coating layers are very thin and are always damaged during transportation or at the latest during the mechanical compacting of the waste in the dumping area. Microbes and moisture thus find a way into the material between the plastic layers and, together with the cellulase enzyme added as provided by the invention, effect decomposition of the product. Besides, decomposition is not always dependent on the coating being damaged, because microbes are able to penetrate into the material between the plastic layers through the seams in the product and, especially in the case of thin PE coating films used on cardboard for disposable cups and plates, through the micropores in the coating film.

In experiments arranged in connection with the present invention, the decomposition of undamaged drink cups and yoghurt containers made of cardboard with a polyethylene coating on one or both sides was investigated by burying samples of said products in the earth. During the first two months, no appreciable decomposition, measured in terms of weight, took place. However, after about half a year from the beginning of the experiment, the cardboard in the product with one-sided coating had been totally decomposed, and the cardboard in the products coated on both sides had been reduced to clearly less than half the original weight. From these results it is obvious that a plastic coating does retard the decomposition of cardboard but does not prevent it.

The present invention also relates to a paper or cardboard product manufactured by the method described above from a mass containing cellulose, characterized in that the product contains a cellulase enzyme added to it during the manufacturing process, said enzyme causing the product to decompose when exposed to moisture.

The cellulase enzyme may be contained in the surface sizing, e.g. starch, or in the coating pigment on the product. The product of the invention may also be provided with a plastic coating, e.g. a polyethylene coating, either on one side or both sides.

The product of the invention is typically cardboard containing a cellulase enzyme and used in the manufacture of packages for liquids such as milk, sour milk, cream and juice, of packing boxes for stuffs like eggs, processed food or cigarettes, of disposable containers such as plates and drink cups, or wrapping paper containing a cellulase enzyme and used for the packaging of e.g. meat, cheese and other foodstuffs.

Below is a description of experimental results relating to the manufacturing of a cardboard product containing a cellulase enzyme and to cardboard products of the invention. Most of the results are based on a measurement of the degree of activity of the enzyme introduced into the cardboard. For the measurement, the standard procedure for determination of the cellulase had to be modified to enabie the cellulase in the pulp to be determined. The procedure was based on CMC addition, whereby the reductible sugar formed enzymatically in the sodium citrate buffer after incubation (ph 4.8) was determined using dinitrosalicylic acid. The modification to the standard procedure consisted in that the mixture was subjected to centrifugation after the colour reaction, before the determination of adsorbance with 550 nm. This was necessary because the pulps were so thick (1% and 3%) that spectrophotometric analysis would not otherwise have been possible.

The possibilities of introducing a cellulase enzyme into cardboard were studied by producing cardboard by the conventional method. The board was surface sized on both sides at a temperature of 55°-65° C., using a 6% oxidized starch solution. The amount of surface sizing solution used was 108g/m$^2$, and the sizing time was 3h. The cellulase enzyme, spezyme FP 100, was mixed in the surface sizing solution. The curve in Fig. I below shows the amounts of cellulase added to the board, expressed in terms of activity units per kilogram, and the corresponding amounts of cellulase found in the finished board. It can be seen from the results that a cellulase enzyme can be introduced into the board without appreciable enzyme losses due to destruction during surface sizing. No flaws of appearance and no alien smells were detected in the cardboard thus produced. Similar experiments were also made to study the possibilities of introducing a cellulase enzyme into cardboard in connection with pigment coating. The coating paste contained calcium carbonate and kaoline in suspension form, and the cellulase enzyme, spezyme FP 100, was mixed in the paste in doses of varying size. The doses of cellulase in activity units per kilogram and the corresponding amounts of cellulase found in the finished board are indicated by the curve in Fig. I, showing that this method also yields good results as a means of introducing the enzyme into the cardboard.

The degree to which a cellulase enzyme is preserved in plastic coated cardboard was studied by providing one side of the above mentioned cardboard with a coat of polyethylene, which was applied in the molten state at 322° C., using 14 g of polyethylene per square metre. The enzyme activity values in FPase units/kg, measured from the cardboard before and after coating, are presented in the table below.

TABLE I

| Enzyme activity before application of PE coat (FPase units/kg) | Enzyme activity after application of PE coat (FPase units/kg) |
|---|---|
| 190 | 160 |
| 380 | 250 |

It can be seen from these results that most of the enzyme activity is preserved after PE coating. The slight loss can easily be compensated by increasing the amount of enzyme introduced into the cardboard.

It is to be expected that in particular processed food in cardboard packages will be heated in microwave ovens. For this reason, cardboard packages containing a cellulase enzyme were kept in a 750W microwave oven for various lengths of time to see how well the enzyme is preserved in the cardboard. The results are presented in the following table II, the enzyme activity values being given in FPase units/kg.

TABLE II

| Heating time in microwave oven (min) | Enzyme activity after heating (FPase units/kg) |
|---|---|
| 0 | 300 |
| 1 | 250 |
| 3 | 220 |
| 5 | 250 |

The results indicate that the enzyme suffers no significant loss of activity when the cardboard is heated in a microwave oven.

Furthermore, an essential feature is the fact that the cellulase enzyme in the cardboard maintains its activity throughout the time from manufacturing till dumping. The results of a preliminary experiment so far carried out indicate that enzyme activity is not significantly reduced during five months of storage. The following table III presents the enzyme activity values measured in five samples of cardboard without plastic coating after 4 days and 154 days of storage in room temperature.

TABLE III

| Amount of enzyme in cardboard (FPase units/kg) | Enzyme activity measured from the cardboard after storage (FPase units/kg) | | |
|---|---|---|---|
| | Duration of storage 4 days | Duration of storage 25 days | Duration of storage 154 days |
| 94 | 130 | | 110 |
| 190 | 190 | | 120 |
| 380 | 320 | 300 | 220 |
| 380 | 320 | | 290 |
| 380 | 320 | | 230 |

The decomposition of cardboard containing cellulase enzyme, manufactured as provided by the present invention, was compared to the decomposition of conventional cardboard without enzyme in an experiment where cardboard samples were placed in water containing implanted bacteria of the pseudomonas putida and bacillus subtilis species. The amount of carbon dioxide generated, which is a direct quantitative indication of the decomposition of cellulose, was measured after various lengths of time. Water was used in large amounts so that it could not constitute a restriction on the decomposition process. The following table presents the cumulative amounts of carbon dioxide generated as a function of time, measured in milligrams from a sample of water containing no cardboard, from conventional cardboard with no enzyme, and from two samples of cardboard containing cellulase enzyme as provided by the invention in which the enzyme activity values were 200 and 400 FPase units/kg. In each case, 1 kg of cardboard was used in the experiment.

TABLE IV

| Duration of the experiment (days) | Cumulative amount of carbon dioxide (mg) | | | |
|---|---|---|---|---|
| | No cardboard | Conventional cardboard | Cardboard with 200 FPase units/kg | Cardboard with 400 FPase units/kg |
| 0 | 0 | 0 | 0 | 0 |
| 7 | 3 | 3.5 | 14.5 | 15 |
| 14 | 3.3 | 10.5 | 29 | 32 |
| 21 | 4 | 17 | 38 | 49 |
| 28 | 4.2 | 23 | 75 | 88 |
| 35 | 4.5 | 29 | 110 | 199 |
| 42 | 4.9 | 35 | 150 | 190 |
| 49 | 5.3 | 38 | 176 | 260 |
| 56 | 5.5 | 41 | 204 | 330 |
| 63 | 5.7 | 43 | 228 | 366 |
| 70 | 6 | 45 | 244 | 398 |
| 77 | | | | |
| 84 | 7 | 55 | 288 | 428 |
| 91 | | | | |
| 98 | | | | |
| 105 | 8 | 57 | 310 | 449 |

The results show that cardboard containing a cellulase enzyme as provided by the invention decompose at a rate several times higher than the rate of decomposition of conventional cardboard with no enzyme.

It is obvious to a person skilled in the art that different embodiments of the invention are not restricted to the examples presented above, but that they may instead be varied within the scope of the following claims.

I claim:

1. Method of manufacturing a paper or cardboard product in a paper or cardboard machine having a dry end region from a mass containing cellulose, comprising the steps of introducing the mass into the machine, passing the mass through the machine and forming a paper or cardboard web, and adding a cellulase enzyme into the web in the dry end region of the machine where the web has a moisture content in the range of 2–55% for forming a product which decomposes when exposed to moisture.

2. Method, as set forth in claim 1, wherein adding the cellulase enzyme into the web during calendering.

3. Method, as set forth in claim 1, wherein adding the cellulase enzyme in the form of a solution.

4. Method, as set forth in claim 1, wherein introducing the cellulase enzyme in an amount of at least 5,000 FPase separate units/1 ton of product.

5. Method, as set forth in claim 4, wherein adding the cellulase enzyme in the range of 10,000–400,000 FPase units/1 ton of product.

6. Method, as set forth in claim 5, wherein adding the cellulase enzyme in an amount in the range of 50,000–100,000 FPase units/1 ton of product.

7. Method, as set forth in claim 1, including the step of coating at least one side of the product with a plastics material after introducing the cellulase enzyme.

8. Method of manufacturing a paper or cardboard product in a paper or cardboard machine from a mass containing cellulose comprising the steps of adding cellulase enzyme into the product as a surface sizing.

9. Method of manufacturing a paper or cardboard product in a paper or cardboard machine having a dry end region from a mass containing cellulose, comprising the steps of introducing the mass into the machine, passing the mass through the machine and forming a paper or cardboard web, and adding a cellulase enzyme into the web in the dry end region of the machine for forming a product which decomposes when exposed to moisture, adding the cellulase enzyme into the web in pigmentation added to the web.

10. Paper or cardboard product formed of a mass containing cellulose and including a cellulase enzyme introduced into the mass while it is formed into a web whereby the cellulase enzyme causes the product to decompose when exposed to moisture, and the cellulase enzyme is contained in a surface size.

11. Paper or cardboard product, formed of a mass containing cellulose and including a cellulase enzyme introduced into the mass while it is formed into a web whereby the cellulase enzyme causes the product to decompose when exposed to moisture, and the enzyme is contained in a coating pigment on the product.

* * * * *